US008482160B2

(12) United States Patent
Johnson et al.

(10) Patent No.: US 8,482,160 B2
(45) Date of Patent: Jul. 9, 2013

(54) INDUCTIVELY COUPLED POWER MODULE AND CIRCUIT

(75) Inventors: LeRoy B. Johnson, Lowell, MI (US); Jason Turner, Joplin, MO (US); Caleb Browning, Carthage, MO (US); John Malmberg, Joplin, MO (US)

(73) Assignee: L & P Property Management Company, South Gate, CA (US)

( * ) Notice: Subject to any disclaimer, the term of this patent is extended or adjusted under 35 U.S.C. 154(b) by 359 days.

(21) Appl. No.: 12/871,463

(22) Filed: Aug. 30, 2010

(65) Prior Publication Data

US 2011/0062789 A1 Mar. 17, 2011

Related U.S. Application Data

(60) Provisional application No. 61/242,964, filed on Sep. 16, 2009.

(51) Int. Cl.
*H01F 27/42* (2006.01)

(52) U.S. Cl.
USPC ..... 307/104

(58) Field of Classification Search
USPC ..... 307/104
See application file for complete search history.

(56) References Cited

U.S. PATENT DOCUMENTS

| | | | | |
|---|---|---|---|---|
| 2,861,855 | A | 11/1958 | Leshner | |
| 4,210,859 | A | 7/1980 | Meretsky | |
| 4,301,494 | A | 11/1981 | Jordan | |
| 4,379,988 | A | 4/1983 | Mattatall | |
| 4,591,777 | A | 5/1986 | McCarty et al. | |
| 4,647,831 | A | 3/1987 | O'Malley et al. | |
| 4,672,292 | A | 6/1987 | Hernandez | |
| 4,739,242 | A | 4/1988 | McCarty et al. | |
| 5,266,881 | A | 11/1993 | Hoffman | |
| 5,329,979 | A | 7/1994 | Miller | |
| 5,536,979 | A * | 7/1996 | McEachern et al. | 307/104 |
| 5,686,809 | A | 11/1997 | Kimura et al. | |
| 5,730,066 | A | 3/1998 | Auten et al. | |
| 5,736,837 | A | 4/1998 | Noda | |

(Continued)

FOREIGN PATENT DOCUMENTS

| | | | |
|---|---|---|---|
| WO | 2004038888 | A2 | 5/2004 |
| WO | 2005086313 | A2 | 9/2005 |
| WO | 2009047768 | A2 | 4/2009 |
| WO | 2009108959 | A1 | 9/2009 |

OTHER PUBLICATIONS

International Search Report mailed Jul. 7, 2009 regarding Appl. No. PCT/US09/41508.

(Continued)

*Primary Examiner* — Robert L. Deberadinis
(74) *Attorney, Agent, or Firm* — Shook Hardy & Bacon LLP

(57) ABSTRACT

Inductive coupling modules for providing power to secondary devices placed in proximity thereto on a surface are described. The modules include above-surface, flush, recessed, and sub-surface mounting configurations. The modules further include dual housing, single housing, low-profile, and adjustable configurations. Inductively coupled power distribution circuits are also disclosed. The circuits comprise a plurality of segments that are inductively couple together to eliminate wired connections between segments. Each segment may be attached to a section of a modular furniture component to allow ease and safety in rearranging the modular furniture and ease in reconnecting the circuit.

20 Claims, 13 Drawing Sheets

U.S. PATENT DOCUMENTS

| | | | | |
|---|---|---|---|---|
| 5,959,433 | A | 9/1999 | Rohde | |
| 5,963,014 | A | 10/1999 | Chen | |
| 6,041,722 | A | 3/2000 | Baker | |
| 6,055,911 | A | 5/2000 | Krenzer | |
| 6,104,162 | A | 8/2000 | Sainsbury | |
| 6,162,071 | A | 12/2000 | Muller | |
| 6,203,088 | B1 | 3/2001 | Fernandez et al. | |
| 6,204,744 | B1 | 3/2001 | Shafer et al. | |
| 6,331,744 | B1 | 12/2001 | Chen et al. | |
| 6,379,182 | B1 | 4/2002 | Byrne | |
| 6,586,909 | B1 | 7/2003 | Trepka | |
| 6,641,190 | B2 | 11/2003 | Kirchhoff | |
| 6,803,744 | B1 | 10/2004 | Sabo | |
| 6,811,233 | B1 | 11/2004 | Packer | |
| 6,975,198 | B2 | 12/2005 | Baarman et al. | |
| 7,077,179 | B1 | 7/2006 | Camiano et al. | |
| 7,083,421 | B1 | 8/2006 | Mori | |
| 7,109,682 | B2 | 9/2006 | Takagi et al. | |
| 7,132,918 | B2 | 11/2006 | Baarman | |
| 7,164,255 | B2 | 1/2007 | Hui | |
| 7,211,986 | B1 | 5/2007 | Flowerdew | |
| 7,239,110 | B2 | 7/2007 | Cheng et al. | |
| 7,248,017 | B2 | 7/2007 | Cheng et al. | |
| 7,262,700 | B2 | 8/2007 | Hsu | |
| 7,271,569 | B2 | 9/2007 | Oglesbee | |
| 7,375,492 | B2 | 5/2008 | Calhoon et al. | |
| 7,375,493 | B2 | 5/2008 | Calhoon et al. | |
| 7,378,817 | B2 | 5/2008 | Calhoon et al. | |
| 7,405,536 | B2 | 7/2008 | Watts | |
| 7,408,324 | B2 | 8/2008 | Baarman et al. | |
| 7,522,878 | B2 | 4/2009 | Baarman | |
| 7,566,984 | B2 | 7/2009 | Blanchard | |
| 7,654,483 | B1 * | 2/2010 | Martin et al. | 242/303 |
| 2002/0008044 | A1 | 1/2002 | Burrus, IV | |
| 2004/0195767 | A1 | 10/2004 | Randall | |
| 2005/0007067 | A1 | 1/2005 | Baarman et al. | |
| 2005/0140482 | A1 | 6/2005 | Cheng et al. | |
| 2005/0156560 | A1 | 7/2005 | Shimaoka et al. | |
| 2006/0043927 | A1 | 3/2006 | Beart et al. | |
| 2006/0061323 | A1 | 3/2006 | Cheng et al. | |
| 2006/0075862 | A1 | 4/2006 | Parks et al. | |
| 2006/0100764 | A1 | 5/2006 | Adams et al. | |
| 2006/0131193 | A1 | 6/2006 | Sherman | |
| 2006/0202665 | A1 | 9/2006 | Hsu | |
| 2007/0182367 | A1 | 8/2007 | Patrovic | |
| 2007/0236174 | A1 | 10/2007 | Kaye | |
| 2007/0247005 | A1 | 10/2007 | Tetlow | |
| 2007/0279002 | A1 | 12/2007 | Partovi | |
| 2008/0129246 | A1 | 6/2008 | Morita et al. | |
| 2009/0072782 | A1 | 3/2009 | Randall | |
| 2009/0079387 | A1 | 3/2009 | Jin et al. | |
| 2009/0153098 | A1 | 6/2009 | Toya et al. | |
| 2009/0158971 | A1 | 6/2009 | Carter | |
| 2009/0179611 | A1 | 7/2009 | Sander et al. | |
| 2009/0212637 | A1 | 8/2009 | Baarman et al. | |
| 2009/0212639 | A1 | 8/2009 | Johnson | |
| 2009/0230777 | A1 * | 9/2009 | Baarman et al. | 307/104 |
| 2010/0038970 | A1 | 2/2010 | Cook et al. | |
| 2010/0164298 | A1 | 7/2010 | Karalis et al. | |
| 2010/0164458 | A1 | 7/2010 | Pollard | |
| 2011/0050164 | A1 * | 3/2011 | Partovi et al. | 320/108 |
| 2012/0026724 | A1 * | 2/2012 | Metcalf et al. | 362/127 |

OTHER PUBLICATIONS

PCT Notification of Transmittal of the International Search Report and the Written Opinion mailed Jul. 6, 2009_regarding_Appl. No. PCT_US09_41513.

PCT Notification of Transmittal of International Preliminary Report on Patentability mailed Aug. 13, 2010 re Appl. No. PCT/US09/41513.

Non-Final Office Action mailed Aug. 18, 2010 re U.S. Appl. No. 12/391,735, filed Feb. 24, 2009, including Scientific and Technical Information Center, EIC 2800 Search Report, 44 pages.

Non-Final Office Action mailed Aug. 19, 2010 re U.S. Appl. No. 12/391,698, filed Feb. 24, 2009,17 pages.

Non-Final Office Action mailed Aug. 19, 2010 re U.S. Appl. No. 12/391,714, filed Feb. 24, 2009, 20 pages.

PCT Notification of Transmittal of International Search Report and the Written Opinion of the International Searching Authority, or the Declaration mailed Nov. 4, 2010 regarding Appl. No. PCT/US2010/048053.

PCT Notification of Transmittal of International Preliminary Report on Patentability, Mail Date: Jan. 11, 2011, PCT/US09/41508, Applicant: L & P Property Management Company, 12 pages.

Final Office Action mailed Feb. 4, 2011 re U.S. Appl. No. 12/391,714, filed Feb. 24, 2009, 12 pages.

Final Office Action mailed Feb. 15, 2011 re U.S. Appl. No. 12/391,735, filed Feb. 24, 2009, 15 pages.

Final OA mailed Feb. 16, 2011 re U.S. Appl. No. 12/391,698, filed Feb. 24, 2009, 11 pages.

EIC 2800 Search Report provided by the Examiner in U.S. Appl. No. 12/391,735, 18 pages.

Final Office Action mailed Apr. 23, 2012, in U.S. Appl. No. 12/391,698, 17 pp.

Non final Office Action mailed Apr. 25, 2012, in U.S. Appl. No. 12/391,714, 34 pp.

Notice of Allowance mailed Apr. 5, 2012, in U.S. Appl. No. 12/391,735, 17 pp.

Non-final OA mailed Sep. 1, 2011, U.S. Appl. No. 12/391,698, 11 pages.

Non-final OA mailed Oct. 18, 2011, U.S. Appl. No. 12/391,735, 11 pages.

Final OA mailed Oct. 24, 2012, U.S. Appl. No. 12/391,714, 12 pp.

Notice of Allowance mailed Dec. 6, 2012, in U.S. Appl. No. 12/391,698, 12 pp.

* cited by examiner

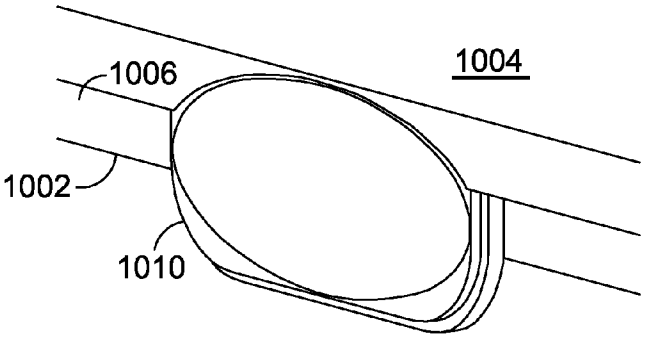
FIG. IIB
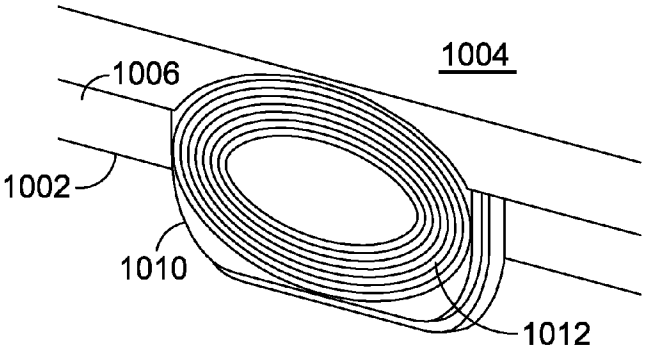
FIG. IIA
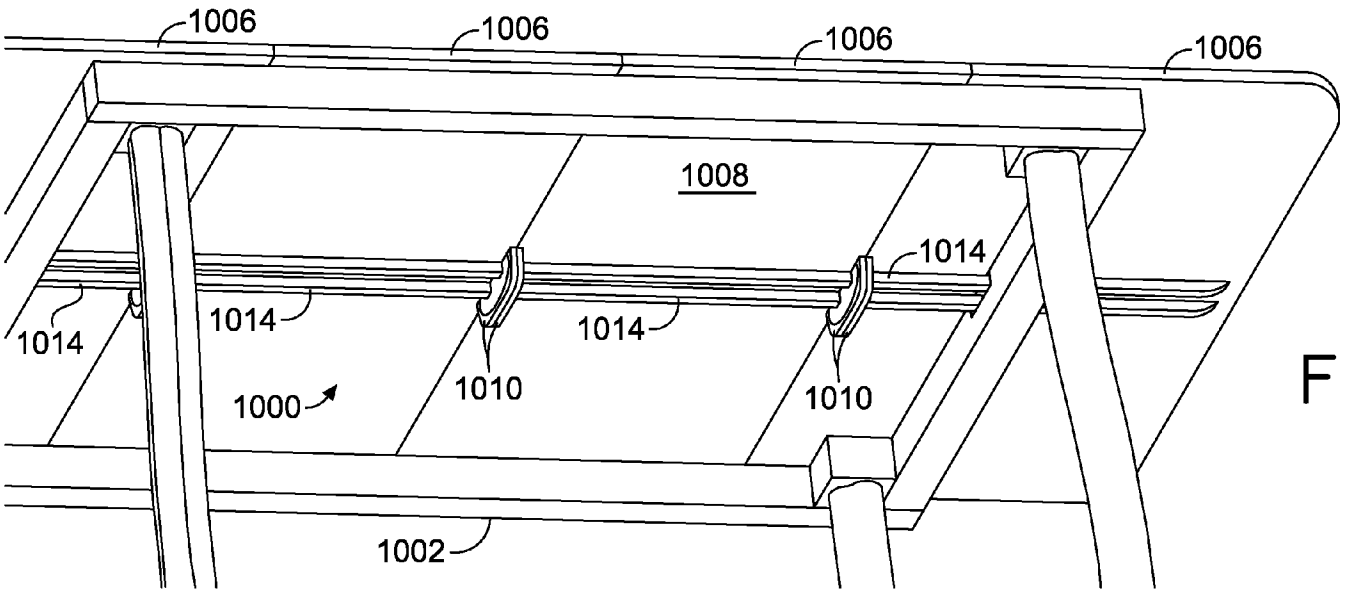
FIG. I2

INDUCTIVELY COUPLED POWER MODULE AND CIRCUIT

CROSS REFERENCE TO RELATED APPLICATIONS

This non-provisional patent application claims priority to U.S. Provisional Patent Application No. 61/242,964, filed Sep. 16, 2009 and is related by subject matter to U.S. Provisional Patent Application No. 61/142,557, filed Jan. 5, 2009; U.S. Provisional Patent Application No. 60/031,132, filed Feb. 25, 2008; U.S. Non-provisional patent application Ser. No. 12/391,714, filed Feb. 24, 2009; U.S. Non-provisional patent application Ser. No. 12/391,735, filed Feb. 24, 2009; and U.S. Non-provisional patent application Ser. No. 12/391,698. The disclosure of each of which is hereby incorporated by reference herein in its entirety.

BACKGROUND

One of the problems associated with many of the electronics so common in today's world is the necessity for cords and cables associated with the various electronic components. Rechargeable cordless devices are a common alternative. But these devices still require charging and the associated cords and cables to accommodate charging.

Technology has been developed to address these limitations by providing an inductively coupled power circuit. This circuit dynamically seeks resonance and optimizes power transfer from a primary coil to a secondary device with a secondary coil. Power transfer can occur under multiple, varying load conditions. By using this circuit, the primary supply circuit adapts its operation to match the needs of the secondary devices being supplied with power. The circuit also allows the primary supply circuit to supply power to multiple secondary devices simultaneously.

This type of inductively coupled power circuit may be utilized in the design of industrial work surfaces, office surfaces, household surfaces, and other surfaces.

SUMMARY

Embodiments of the invention generally relate to modules and apparatus for providing power to one or more secondary devices through an inductive coupling. Embodiments of the invention include inductive coupling modules (hereinafter modules) that are mounted in or on a panel such that secondary devices placed on a surface of the panel opposite the modules are provided with power for operation or for charging of one or more batteries therein. The modules may be adjustable to enable integration of the modules into surfaces of any thickness.

In another embodiment of the invention, an electrical circuit for providing power to one or more secondary devices via one or more inductively coupled segments is provided. The electrical circuit includes a plurality of segments having an inductive coupling device at each end. The segments are mounted on or integrated into an object, such as a section of a modular desktop. Multiple sections of the modular desktop are abutted in a desired arrangement thereby aligning the inductive coupling devices of each section. Thus, an electrical circuit is formed via the coupling of the inductive coupling devices. As such, power is supplied between the segments without a physical connection, such as a wire, and allows the segments, and the modular desktop sections, to be easily and safely reconfigured. Further, the electrical circuit may provide power to one or more inductive coupling modules or other devices.

This Summary is provided to introduce a selection of concepts in a simplified form that are further described below in the Detailed Description. This Summary is not intended to identify key features or essential features of the claimed subject matter, nor is it intended to be used in isolation as an aid in determining the scope of the claimed subject matter.

DESCRIPTION OF THE DRAWINGS

Illustrative embodiments of the invention are described in detail below with reference to the attached drawing figures, wherein:

FIG. 11A is a cutaway perspective view depicting an inductive coupling unit mounted in a surface in accordance with an embodiment of the invention;

FIG. 11B is a perspective view of the inductive coupling unit of FIG. 11A in accordance with an embodiment of the invention;

FIG. 12 is a perspective view depicting the underside of a table having an inductive coupling unit mounted thereto in accordance with an embodiment of the invention.

DETAILED DESCRIPTION

The subject matter of embodiments of the invention is described with specificity herein to meet statutory requirements. However, the description itself is not intended to limit the scope of this patent. Rather, the inventors have contemplated that the claimed subject matter might also be embodied in other ways, to include different components or combinations of components similar to the ones described in this document, in conjunction with other present or future technologies.

Figure 1:
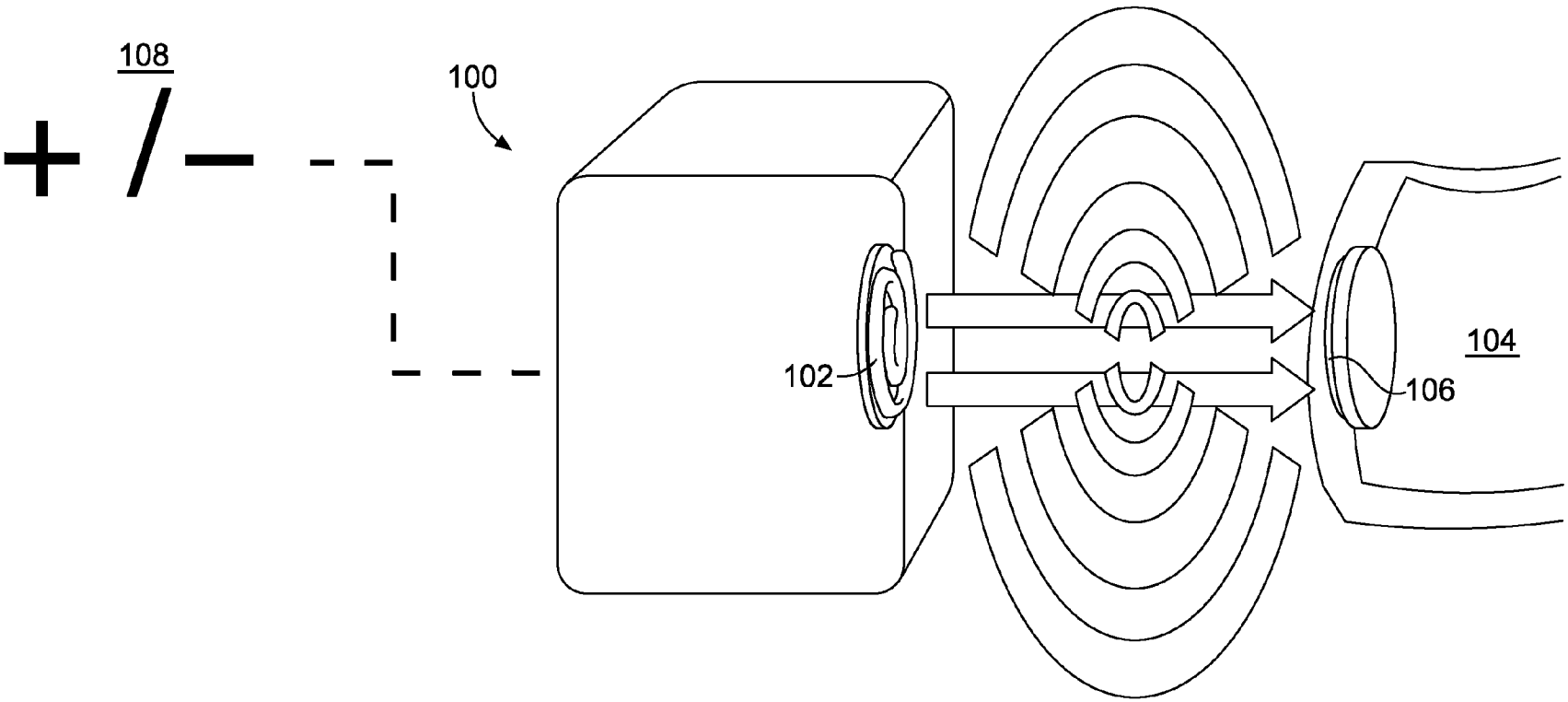
FIG. 1 is an illustration depicting an inductive coupling between a primary coil and a secondary coil in accordance with embodiments of the invention.

As noted in the Background section above, technology has been developed that provides an intelligent, inductively coupled power circuit 100. This circuit 100 dynamically seeks resonance and optimizes power transfer from a primary coil 102 to a secondary device 104 with a secondary coil 106, as depicted in FIG. 1. The circuit 100 allows the primary coil 102 to determine and provide the power needs of the secondary device 104. By using this circuit 100, the primary supply circuit 108 adapts its operation to match the needs of the secondary devices 104 being supplied with power. The circuit 100 also allows the primary supply circuit 108 to supply power to multiple secondary devices 104 simultaneously.

Primary coils 102 may be designed to provide a low, medium, or high quantity of power and may be selected and used based on the power requirements of the secondary devices 104 with which they are to be used. A low power primary coil 102 is designed to provide up to approximately 20 watts of power transferred through the primary coil 102 to a secondary device coil 106. A medium power primary coil 102 is designed to provide approximately between 20 and 100 watts of power transferred through the primary coil 102 to a secondary device coil 106, although more or less power could also be provided. A primary coil 102 designed to provide more than approximately 100 watts of power is designated as a high power primary coil 102. The designations of low, medium, and high power are described herein for explanatory purposes only and are not intended to limit the design, usage, or construction of embodiments of the invention.

Inductively coupled electrical circuits can be used to power and recharge cordless secondary devices 104, including, for example and not limitation, cell phones, personal data assistants (PDA), flashlights, lamps, laptop computers, and power tools. Each cordless secondary device 104 has a secondary coil 106 that when placed into proximity to the primary coil 102 is automatically recognized and coupled thereto as is known in the art. As depicted in FIG. 1, two-way communication may be established between a primary device and the secondary device 104 to identify power needs, battery life, and charging cycle, among other information.

In an embodiment, an inductively coupling module is described. The inductively coupling module includes a housing coupled to a first side of a panel with at least a portion of the housing extending into a cavity in the first side. The module also includes an induction coil disposed within the housing and located within an operating distance of a top surface of a second side of the panel opposite the first side. The induction coil is in contact with or is adjacent to an interior surface of the cavity with or without a wall of the housing disposed between the induction coil and the interior surface of the cavity. Control electronics are also disposed within the housing for controlling the operation of the induction coil and connecting to a power source.

In another embodiment, an inductively coupling power distribution circuit for an article of modular furniture is described that includes first and second induction coils and an electrical conductor. The first induction coil is disposed along a first side of a first article of modular furniture. The second induction coil is disposed along a second side of the first article of modular furniture. The electrical conductor is coupled to both the first and second induction coils and provides electrical communication between the coils. The first article of modular furniture is inductively coupled to one or more of a source of electrical power and one or more second similarly configured articles of modular furniture. And one or more electronic devices are coupled to the electrical conductor to supply power to the electronic devices.

In another embodiment, an inductively coupling power distribution circuit for an article of modular furniture is described. The circuit includes desktop panels, first and second induction coils on each desktop panel, an electrical conductor between each first and second induction coil, inductively coupling modules, and electrical coupling between first and second induction coils of separate panels and with a power source. The first induction coil is disposed along a first edge of each of the plurality of desktop panels. The second induction coil is disposed along a second edge of each of the plurality of desktop panels. The second edge is the same or different than the first edge. The electrical conductor coupled between the respective first and second induction coils on each desktop panel provides electrical communication between the first and second induction coils. The inductively coupling modules are disposed on or within an underside of each of the desktop panels and are electrically coupled to the electrical conductor on their respective panel. At least one of the first or second induction coils are inductively coupled to the first or second induction coil disposed on another desktop panel to form an electrical circuit connecting all of the desktop panels.

Inductively Coupling Modules

Referring now to FIGS. 2-8, inductive coupling modules (modules) are described in accordance with embodiments of the invention. As described below, embodiments of the modules are designed to be mounted in, and adaptable to, a variety of surfaces having varying thicknesses. The surfaces include any surface upon which it may be advantageous to provide power via inductive coupling of devices such as, for example and not limitation, panels, tabletops, desktops, shelving, consoles, countertops, and furniture surfaces, among a variety of others (hereinafter collectively referred to as panels). The modules are also designed to be mounted in a variety of orientations with respect to the top surface of the panel including protruding above the panel, flush with the panel surface, sub-flush with the panel surface, and beneath, e.g. under, the panel surface.

Figure 2:
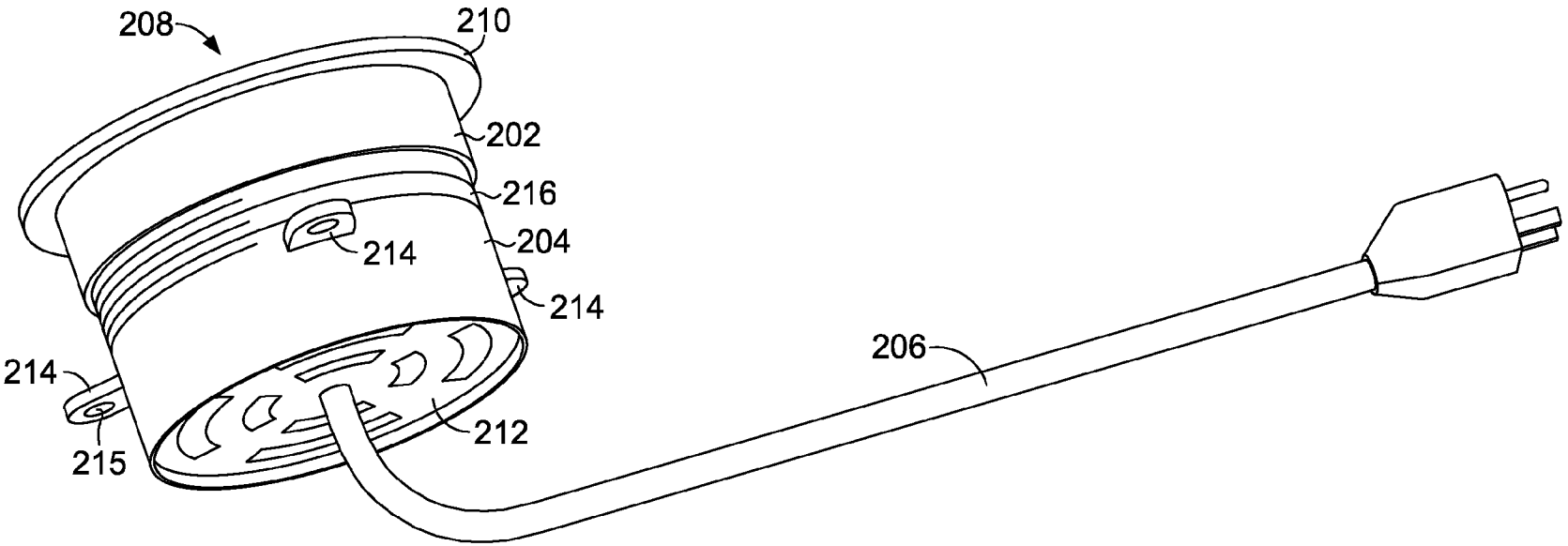
FIG. 2 is a three-dimensional rendering depicting an inductive coupling module suitable for mounting in a through-hole configuration in accordance with an embodiment of the invention.

With reference now to FIG. 2, an inductive coupling module 200 is described in accordance with an embodiment of the invention. The module 200 includes an upper housing 202, a lower housing 204, and a power cord 206. The upper housing 202 is a hollow, generally cylindrical component having an open end and a closed end formed by a top face 208. An annular ring 210 extends from the upper housing 202 adjacent to the top face 208. The upper housing 202 may include threads or other features along an interior surface for coupling to the lower housing 204.

The lower housing 204 is also a hollow, open-ended, generally cylindrical component. The power cord 206 extends from a bottom face 212 and a plurality of tabs 214 extend from an outer surface of the lower housing 204. The tabs 214 each include an aperture 215 through which a fastener such as a screw, bolt, nail, or rivet may be inserted. The lower housing 204 also includes threads 216 or other features along the outer surface for coupling to complimentary features on the interior of the upper housing 202.

The upper housing 202, together with the lower housing 204, encloses an induction coil, associated electronic hardware, and control circuitry within the module 200. The induction coil (not shown) is attached to, or is biased against or adjacent to the top face 208 of the upper housing 202 such that a distance between the induction coil and a secondary device placed in proximity thereto is minimized.

The components of the module 200 and the embodiments of the invention described below are constructed from any suitable materials and by known methods of manufacture. For example, the upper housing 202 and lower housing 204 are constructed from any suitable materials such as plastics or metals and by any available methods of manufacture. Further, the power cord 206 comprises any available wire or cord and plug technologies for supplying electrical power to the module 200.

The module 200 is designed for mounting in a through-hole configuration in which a cylindrical hole is bored through a panel and the module 200 inserted therein such that the top face 208 is exposed above the surface of the panel. The top face 208 may extend above the surface of the panel, be flush with the surface, or be sub-flush to the surface as desired in a given application. The annular ring 210 may rest on top of the panel to provide impedance to passage of the module 200 through the hole in the panel in a mounting configuration in which the module 200 extends above the surface. Alternatively, an upper portion of the hole in the panel may have a diameter equal to or just larger than that of the annular ring 210 and a depth equal to or just larger than that of the thickness of the annular ring 210 such that the top face 208 is flush or sub-flush with the top of the surface of the panel.

To mount the module 200 in the panel, a through hole is first bored through the panel. The upper housing 202 and the lower housing 204 are separated. The lower housing 204 is inserted into the through hole from beneath the panel and the upper housing 202 inserted from above the panel. The threads 216 of the lower housing engage the threads of the upper housing 202 and the two housings are rotated or screwed together until the tabs 214 are pulled against a bottom face of the panel. The threaded engagement between the upper housing 202 and the lower housing 204 can be tightened or loosened to provide more or less distance between annular ring 210 and the tabs 214. This allows the module 200 to be installed in panels having a range of thicknesses. One or more fixtures such as screws, are inserted through the apertures 215 in the tabs 214 and engage the bottom face of the panel to retain the module 200 in place. The power cord 206 is coupled to a mating electrical connection.

In an embodiment, the module 200 also includes a charging indicator (not shown). The charging indicator may be an LED or other light source. The charging indicator may also be a ring of LEDs or light sources that substantially trace the outline of the top face 208. The charging indicator is illuminated when a secondary coil in a secondary device draws power from the primary coil. Thus, illumination of the charging indicator occurs when a secondary device is placed on the module 200 and charges. In other embodiments, a light pipe or electrical connection are used to place a charging indicator anywhere on the panel.

Figure 3D:
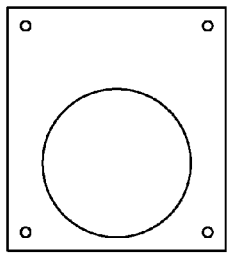
FIG. 3D is top plan view of the inductive coupling module of FIG. 3A in accordance an embodiment of the invention.
Figure 3C:
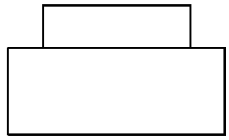
FIG. 3C is an end elevational view of the inductive coupling module of FIG. 3A in accordance an embodiment of the invention.
Figure 3B:
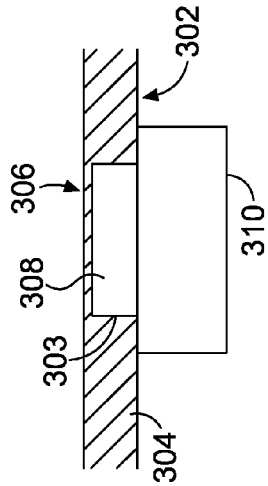
FIG. 3B is a cutaway side elevation of the inductive coupling module of FIG. 3A installed in a surface in accordance with an embodiment of the invention.
Figure 3A:
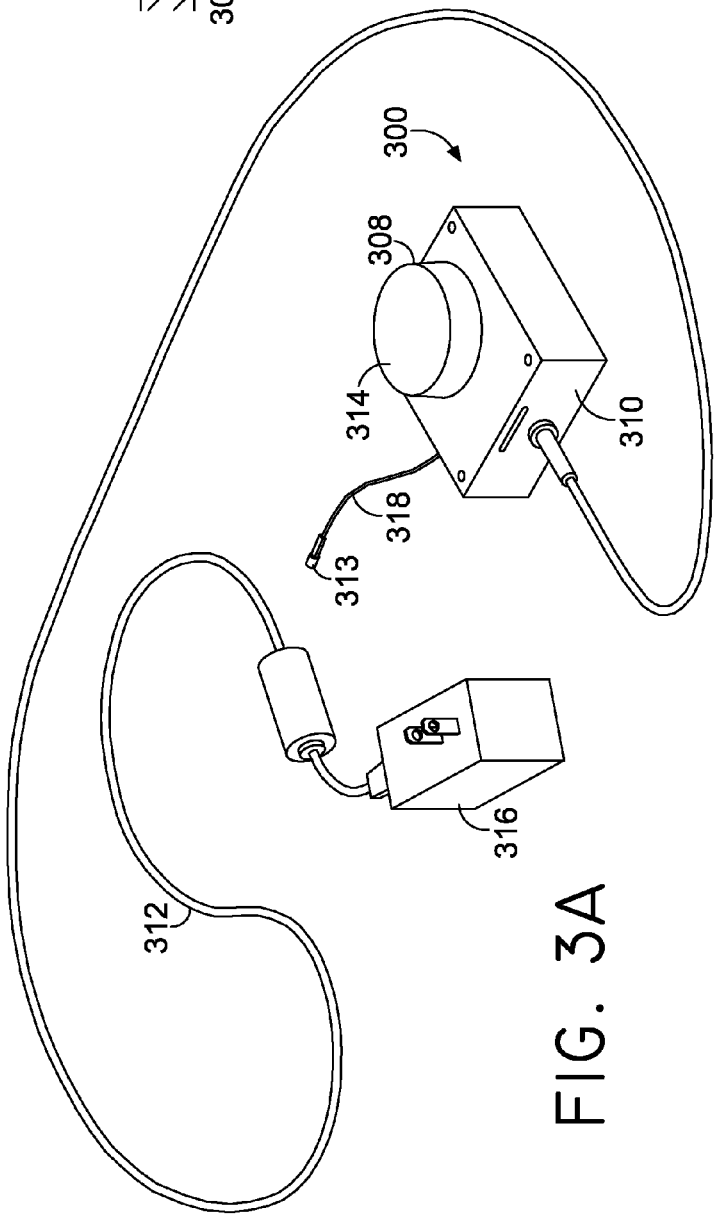
FIG. 3A is a perspective view depicting an inductive coupling module suitable for sub-surface mounting in accordance with an embodiment of the invention.

With reference now to FIGS. 3A-D, a module 300 is described in accordance with embodiments of the invention. The module 300 is designed for a sub-surface application. In a sub-surface application the module 300 is mounted to a bottom face 302 and/or within a cavity 303 in the bottom of a panel 304 and does not penetrate completely through the panel 304 as depicted in FIG. 3B. As such, the module 300 is not visible from the top 306 of the panel 304. Alternatively, in another embodiment, the module 300 and any indicator lights are mounted below the top surface 306 of the panel 304 within a cavity that extends through the panel 304. The open end of the cavity at the top surface 306 of the panel 304 is covered with a clear plastic sheet or other transparent material that is level with the top surface 306 of the panel 304 such that the module 300 and any indicator lights are visible from above the panel 304.

The module 300 includes an upper housing 308, a lower housing 310, a power cord 312, and a charging indicator 313. The upper housing 308 houses an induction coil (not shown) that is held against or adjacent to a top face 314 of the upper housing 308. The upper housing 308 is depicted as a generally cylindrical hollow component but may take any desired shape or configuration. In embodiments of the invention, a cylindrical configuration of the upper housing 308 is advantageous for allowing ease of mounting within a circular hole bored in a panel 304.

The lower housing 310 has a rectangular box-like configuration sufficient to house any necessary electrical components and control circuitry for operation of the module 300. In practice it is advantageous to minimize the size of the lower housing 310 so as to minimize obtrusion of the lower housing 310 into the space below the panel 304.

The upper housing 308 is coupled to a top surface of the lower housing 310 by any available method and the induction coil and control circuitry contained therein placed in electrical communication. In an embodiment, the upper housing 308 is integral to the top surface of the lower housing 310.

The power cord 312 extends from the lower housing 310 for connecting the module 300 to an appropriate power supply. The power cord 312 includes a plug 316 suitable for connecting to the power supply.

A cord 318 connecting to the charging indicator 313 also extends from the lower housing 310 from a connection to the control circuitry contained therein. The cord 318 is comprised of any suitable electrical cord available in the art and has any desired length to allow mounting the charging indicator 313 in a desired location. The charging indicator 313 comprises an LED (light emitting diode) or other suitable light source and is controlled by the control circuitry to indicate to a user the status of the module 300. In an embodiment, the charging indicator 313 flashes when the module 300 is charging a secondary device, is continuously illuminated when charging of a secondary device is complete, and is not illuminated when the module 300 is not supplying power to a secondary device.

In operation, the module 300 is mounted to a bottom surface 302 of the panel 304. A cavity 303 is bored part way through the panel 304 extending from the bottom surface 302 into the body of the panel 304 without piercing the top surface 306. In an embodiment, a maximum separation between the top face 314 of the module 300 and the top surface 306 of the panel 304 may be designated by the operating capabilities of the module 300. For example, a maximum separation distance of 3.18 millimeters may be designated to provide optimal performance of the module 300. The maximum separation distance may be determined based on factors such as, for example and not limitation, the operating power of the module 300, the range of the induction coil, and the material that comprises the panel 304. In another embodiment, the height of the upper housing 308 is configured for use in panels 304 of a given thickness such that the maximum separation distance is satisfied.

The module 300 is mounted to the bottom 302 of the panel 304 by inserting the upper housing 308 into the cavity 303. One or more screws, adhesives, or other fixtures are used to affix the lower housing 310 to the bottom 302 of the panel 304. The charging indicator 313 is mounted in a desired location on or adjacent to the panel such that it is visible to a user. The power cord 312 is coupled to an appropriate power source and operation of the module 300 proceeds as described above with respect to module 200.

Figure 4B:
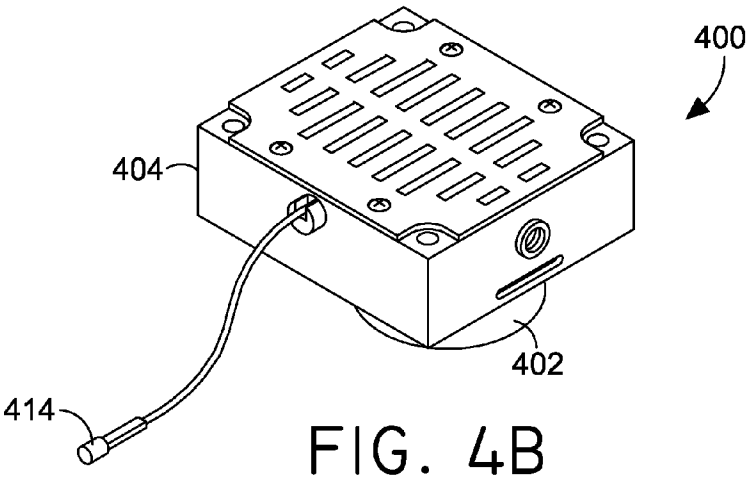
FIG. 4B is a perspective view depicting the low-power inductive coupling module of FIG. 4A in a first orientation in accordance with an embodiment of the invention.
Figure 4C:
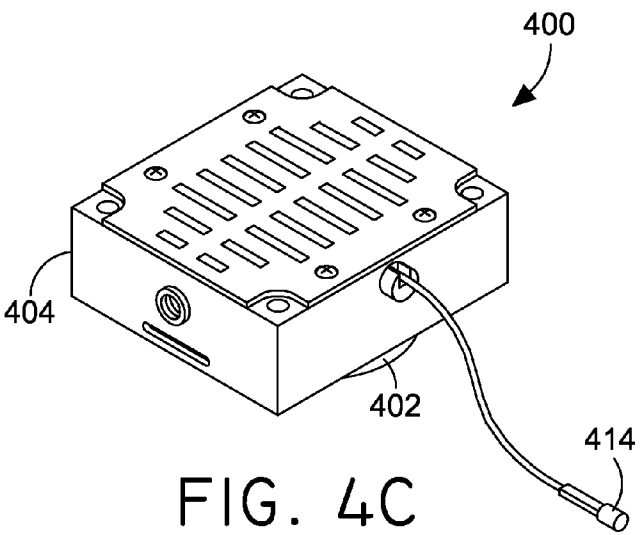
FIG. 4C is a perspective view depicting the low-power inductive coupling module of FIG. 4A in a second orientation in accordance with an embodiment of the invention.
Figure 4A:
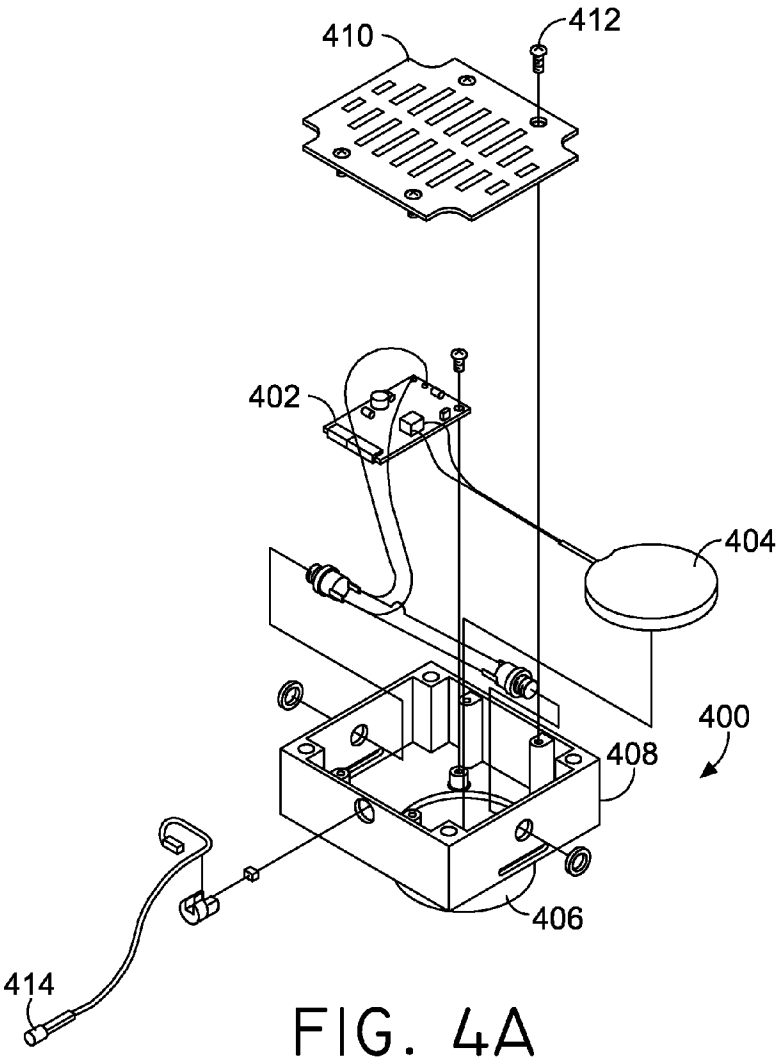
FIG. 4A is an exploded perspective view depicting a low-power inductive coupling module in accordance with an embodiment of the invention.

Referring now to FIGS. 4A-C, a module 400 is described in accordance with another embodiment of the invention. The module 400 includes a low power control unit 402, a low power induction coil 404, and associated components housed within an upper housing 406, and a lower housing 408. The low power control unit 402 and low power induction coil 404 operate as described above and as known in the art and are enclosed within the upper and lower housings 406, 408 by a base plate 410 affixed to the lower housing by a plurality of fixtures 412. A charging indicator 414 is also included, as described above.

In operation, the module 400 operates and is mounted similarly to the module 300 described above. The upper housing 406 is inserted into a cavity in a bottom surface of a panel and the module 400 is secured to the bottom surface by any available method. The mounting configuration places the induction coil 404 within a desired operating distance from a top surface of the panel such that secondary devices having a secondary coil placed in proximity to the induction coil 404 can be powered or charged. The charging indicator 414 is mounted in or adjacent to the panel and provides status information for the module 400 to a user.

Figure 5B:
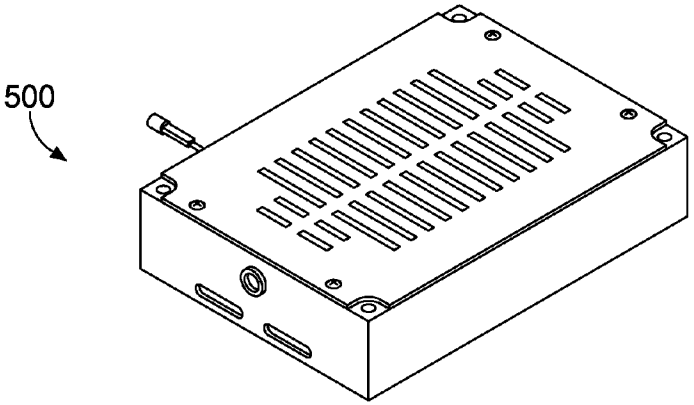
FIG. 5B is a perspective view depicting the medium-power inductive coupling module of FIG. 5A in a first orientation in accordance with an embodiment of the invention.
Figure 5C:
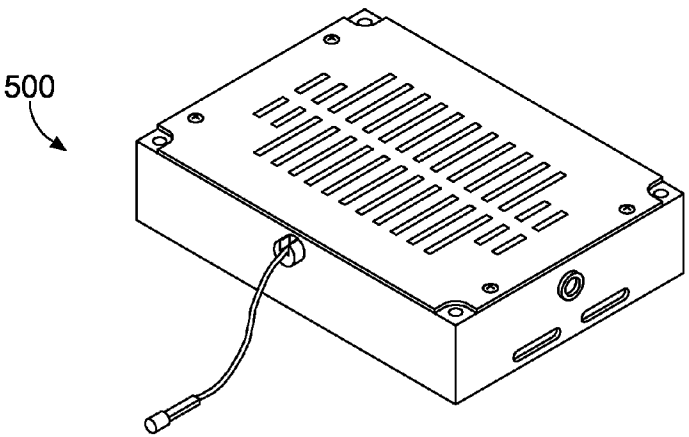
FIG. 5C is a perspective view depicting the medium-power inductive coupling module of FIG. 5A in a second orientation in accordance with an embodiment of the invention.
Figure 5A:
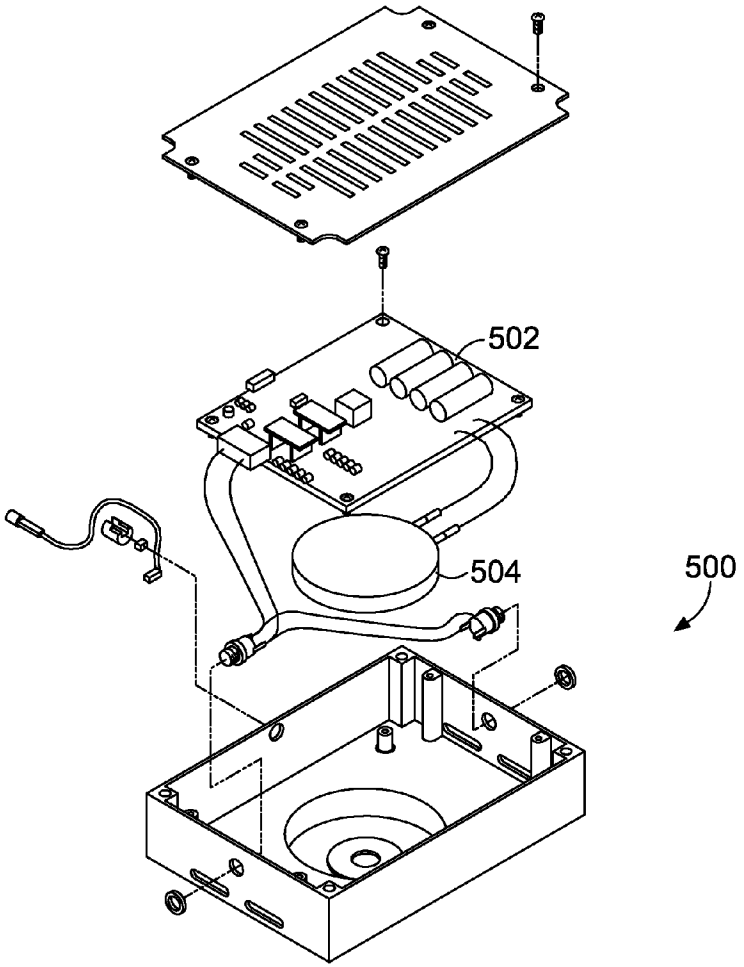
FIG. 5A is an exploded perspective view depicting a medium-power inductive coupling module in accordance with an embodiment of the invention.

FIGS. 5A-C depict a medium power module 500 in accordance with an embodiment of the invention. The module 500 is configured and operates similarly to that of the module 400 described above. However, the module 500 includes medium power control circuitry 502 and a medium power induction coil 504.

Figure 6A:
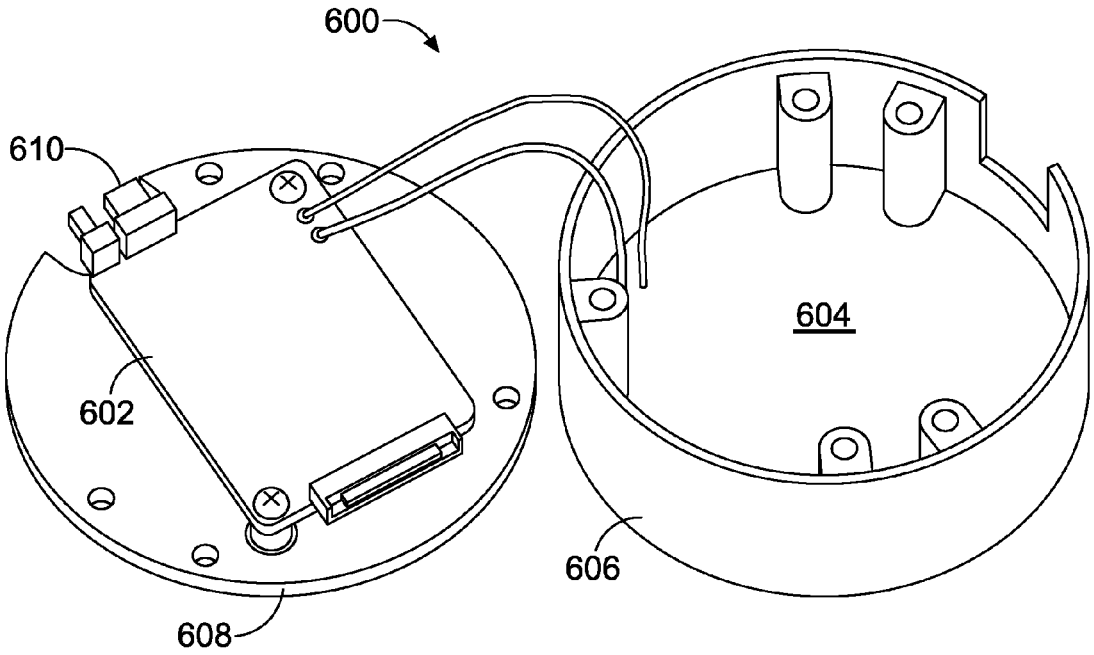
FIG. 6A is a perspective view depicting a disassembled inductive coupling module that includes a single housing in accordance with an embodiment of the invention.
Figure 6B:
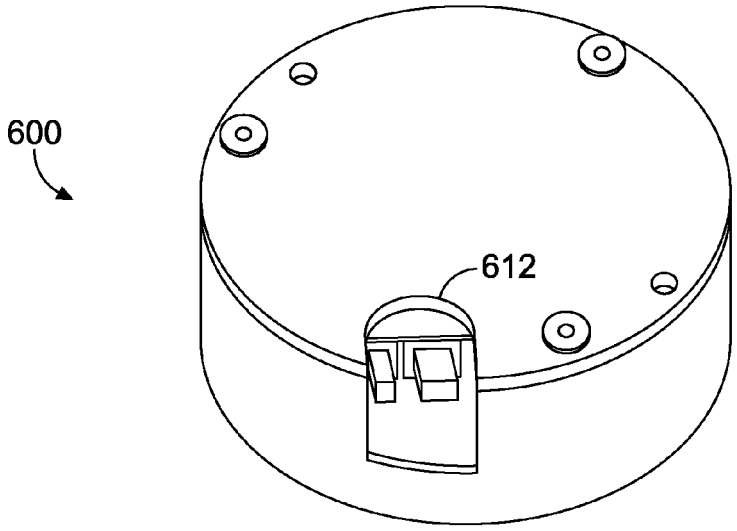
FIG. 6B is a perspective view depicting the inductive coupling module of FIG. 6A in an assembled state in accordance with an embodiment of the invention.

With reference now to FIGS. 6A and B, a module 600 is depicted in accordance with another embodiment of the invention. The module 600, like the modules 300, 400, and 500 described above includes control circuitry 602 and an induction coil 604 however, the module 600 only includes a single housing 606. The housing 606 is a hollow cylindrical component that when coupled to a face plate 608 forms a generally closed container for the control circuitry 602 and induction coil 604 as depicted in FIG. 6B. The module 600 also includes one or more plugs 610 that are accessible through an aperture 612 in the housing 606 and faceplate 608. A power cord (not shown) and a charging indicator (not shown) may be connected to the module 600 via the plugs 610.

In use, the module 600 is mounted to a bottom surface or within a cavity in the bottom surface of a panel. The module 600 is oriented such that the surface of the housing 606 adjacent to the induction coil 604 is nearest the top surface of the panel in which the module 600 is mounted. Due to the cylindrical configuration of the single housing 606 the module 600 can be mounted in a cavity of any depth. The module 600 is connected to a power supply and a charging indicator, if available and desired, via the plugs 610 and operates as described above.

With reference to FIGS. 7A-D, a high-profile adjustable module 700 is depicted in accordance with an embodiment of the invention. The module 700 includes an upper housing 702 and a lower housing 704 that enclose control circuitry 706 and an induction coil 708. The upper housing 702 includes a hollow cylinder having a closed first end 710 and an open second end 712. An annular flange 714 extends radially outward form the second end 712 of the upper housing 702. The induction coil 708 is located within the upper housing 702 against or adjacent to the first end 710.

The lower housing 704 is a generally rectangular hollow box having an aperture 716 on one face. The aperture 716 has dimensions suitable to allow the upper housing 702 to traverse therethrough, but to impede the traversal of the annular flange 714 through the aperture thereby retaining the upper housing 702 from separating from the lower housing 704. Additionally, the lower housing 704 includes various features for supporting and retaining the control circuitry 706 and related hardware.

Figure 7A:
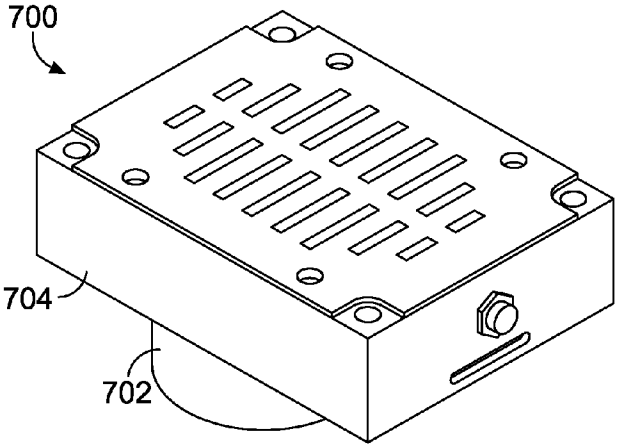
FIG. 7A is a perspective view depicting an adjustable, high-profile inductive coupling module in accordance with an embodiment of the invention.
Figure 7B:
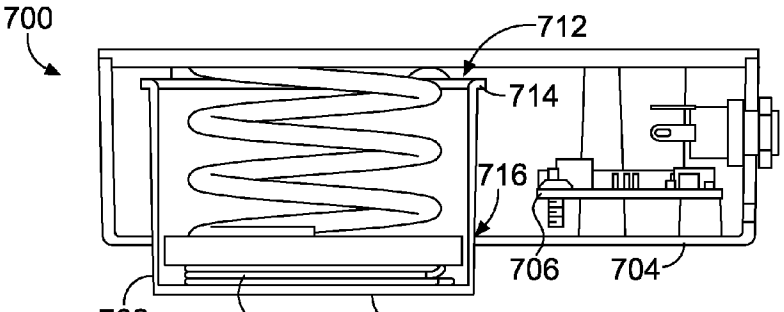
FIGS. 7B-D are cutaway elevational views of the inductive coupling module of FIG. 7A depicting an upper housing in successively extended positions in accordance with an embodiment of the invention.
Figure 7C:
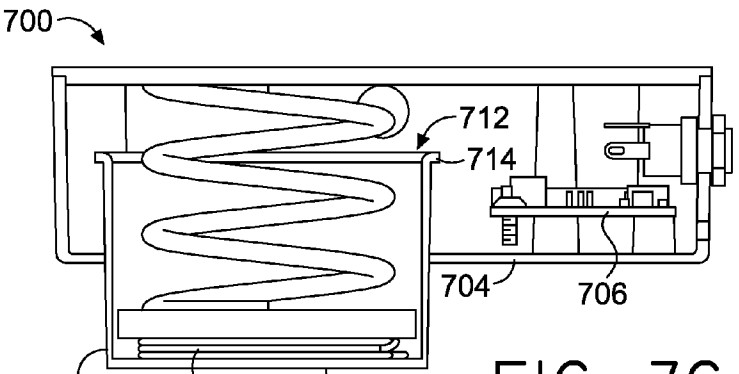
Figure 7D:
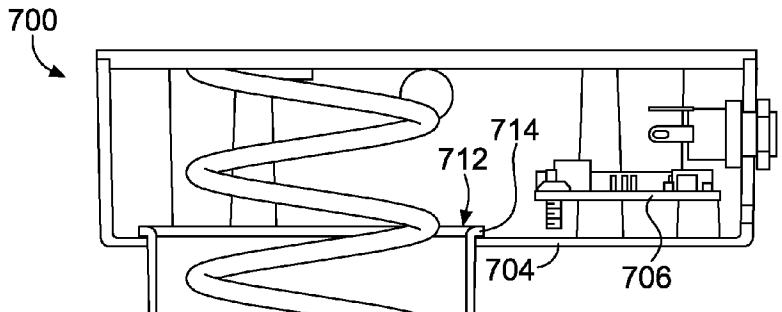

A coil compression spring 718 is placed within the upper housing 702 to bias the upper housing 702 in an extended position as depicted in FIG. 7D. In the extended position the upper housing 702 protrudes from the aperture 716 in the lower housing 704 and the annular flange 714 contacts an interior surface of the lower housing 704 to retain the upper housing 702. As such, the upper housing 702 is compressible into the lower housing 704 by applying a force to the first end 710 of the upper housing 702 and compressing the spring 718.

The module is mounted to a panel similarly to that described previously. The upper housing 702 is inserted into a cavity in the underside of a panel and the lower housing 704 is affixed to the bottom surface of the panel by one or more fixtures. A power cord and a charging indicator are coupled to the module 700 and the module 700 operates as previously described.

The compressibility of the upper housing 702 provides adjustability of the module 700 for mounting in a variety of panels having varied thicknesses. The cavity in which the upper housing 702 is inserted may have any depth from no depth to a depth equal to the full height of the upper housing 702. As such, when inserted into the cavity the extension of the upper housing 702 from the lower housing 704 automatically adjusts by compressing the spring 718 to accommodate the depth of the cavity.

Figure 8B:
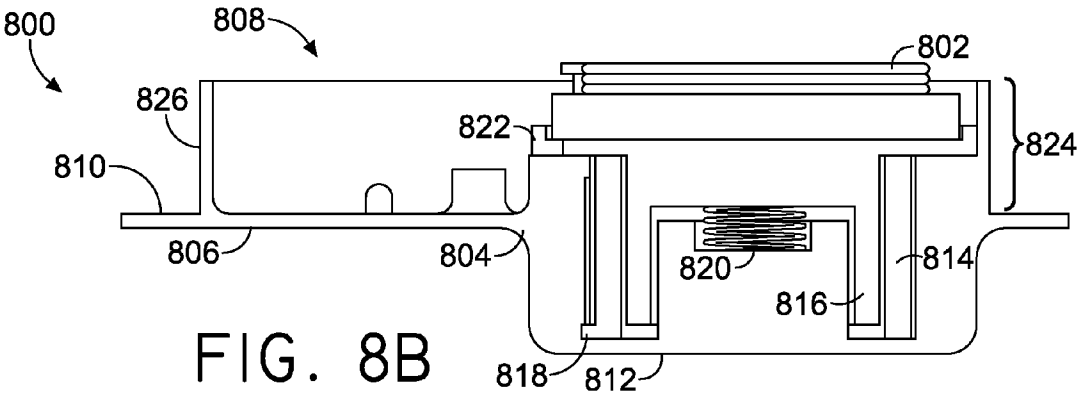
FIG. 8B is a cutaway side elevational view of the low-profile inductive coupling module of FIG. 8A depicting an inductive coil in a retracted position in accordance with an embodiment of the invention.
Figure 8C:
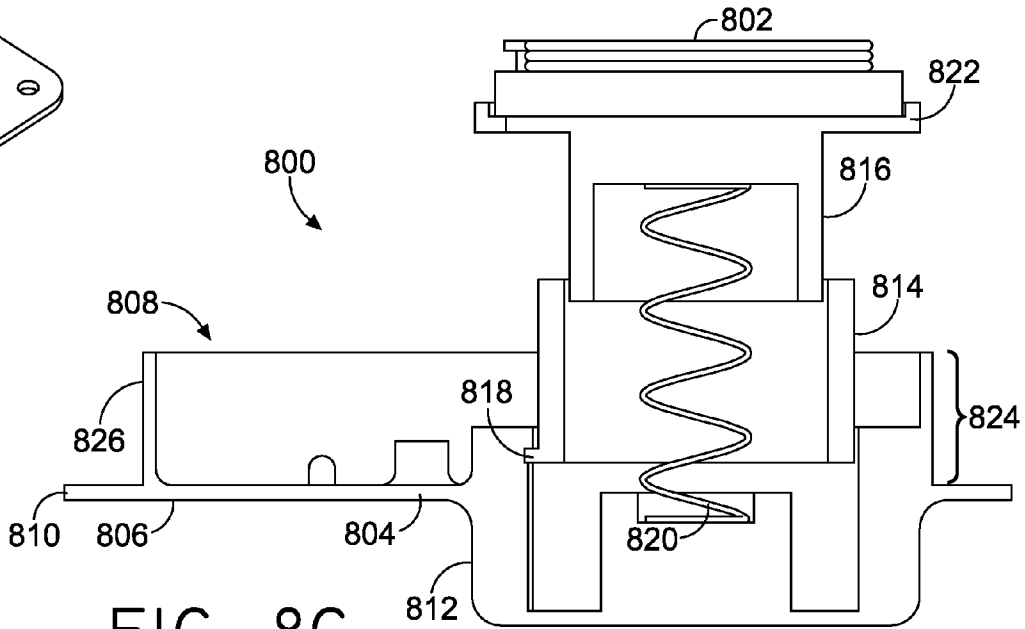
FIG. 8C is a cutaway side elevational view of the low-profile inductive coupling module of FIG. 8A depicting an inductive coil in an extended position in accordance with an embodiment of the invention.
Figure 8A:
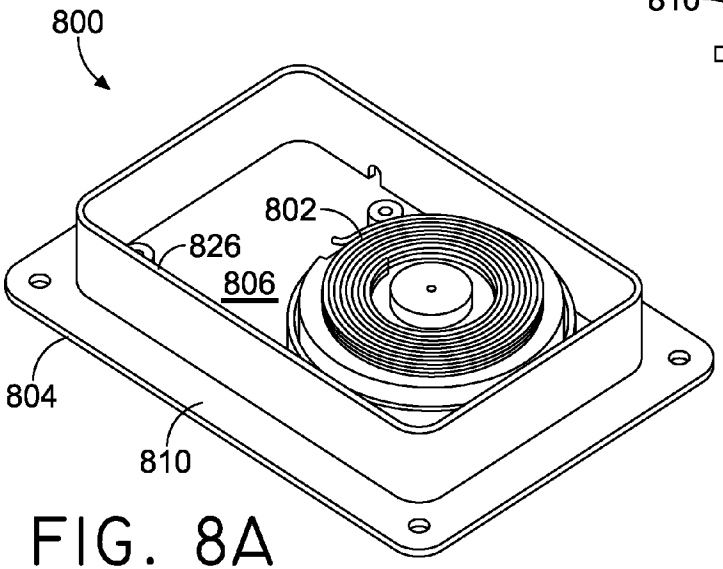
FIG. 8A is a perspective view of an adjustable, low-profile inductive coupling module in accordance with an embodiment of the invention.

A second adjustable module 800 is depicted in FIGS. 8A-C in accordance with another embodiment of the invention. The module 800 employs telescoping components to provide adjustability of the extension of an induction coil 802 from a housing 804. The housing 804 includes a hollow, rectangular box-like portion having a closed first face 806 and an open second face 808. A flange 810 extends about the perimeter of the housing 804 from the first face 806. Further, a portion of the first face 806 protrudes outwardly from the first face to form a hollow cylindrical protrusion 812. A first and a second telescoping member 814, 816 are accepted within the interior of the protrusion 812 and are retained in communication therewith by one or more tabs 818. A coiled compression spring 820 is located internally to the protrusion 812 and the first and second telescoping members 814, 816 to bias the telescoping members 814, 816 in an extended position. The induction coil 802 is affixed to a top surface 822 of the second telescoping member 816. The control circuitry (not shown) and any other necessary hardware are mounted within the remaining portion of the housing 804.

The module 800 is designed for low profile mounting within an underside of a panel such that a large portion of the housing 804 is contained within a panel. A cylindrical cavity (not shown) having suitable dimensions to accept the first and second telescoping members 814, 816 is created in the underside of the panel, such as by drilling or boring. The cylindrical cavity may have any depth between no depth and the full extension length of the first and second telescoping members 814, 816, but must be sufficient to provide less than a maximum thickness of the panel between the cavity and the top surface of the panel. An additional cavity (not shown) is formed in the underside of the panel that has dimensions suitable to accept an upper portion 824 of the housing 804 contained within an outer wall 826. The cylindrical cavity is positioned within the additional cavity so as to align with the first and second telescoping members 814, 816. The first and second telescoping members 814, 816 are inserted into the cylindrical cavity and the housing 804 inserted into the additional cavity such that the flange 810 abuts the underside of the panel. One or more fasteners are placed through the flange 810 to retain the module 800 in the panel.

As such, the induction coil 802 is placed within the cylindrical cavity and against the top surface thereof. The telescoping members 814, 816 adjust to conform to the depth of the cavity as the housing 804 is pressed into the additional cavity. Additionally, as the upper portion 824 of the housing 804 is contained within the panel, only the protrusion 812 extends into the space below the panel. Such a configuration provides a module 800 that is minimally invasive or obstructive to activities or objects beneath the panel. For example, the module 800 greatly decreases the likelihood that a person sitting at a desk in which the module 800 is mounted will notice the module or will bump the module with the person's knee.

Inductively Coupled Circuits

The modules 200-800 described above must be supplied with power in order to function. As described previously, the modules 200-800 may be connected to a standard power source by a common electrical cord or extension cord. There are many drawbacks associated with using standard electrical cords, such as the presence of the cords on a work surface, hanging from a panel such as a desktop, or lying on the floor and the necessity of having extension cords to reach a desired power outlet. The hazards associated with these drawbacks include tripping and entanglement hazards, electrocution hazards, and fire hazards, among others. Accordingly, in embodiments of the invention the modules 200-800 are connected to an inductively coupled circuit mounted on a bottom surface of a panel, or integral therewith.

With reference to FIGS. 9A-D, an inductively coupled circuit 900 (hereinafter "circuit") is described in accordance with an embodiment of the invention. The circuit 900 is depicted mounted in a table portion 902 of a workbench 904. An inductive coupling unit 906 (IC unit) is mounted at each end of the table 902 such that an induction coil (not shown) housed within the IC unit 906 is suitably oriented to inductively couple to a second induction coil coming within proximity thereto. The IC unit 906 is integral to the table 902 and is exposed along a first end 908 of the table 902. A second IC unit 906 is mounted in an identical fashion along a second end 910 of the table 902. In another embodiment, the IC units 906 are mounted within the first and second ends 908, 910 of the table 902 and are not exposed at the end surface. In another embodiment, the IC units 906 are mounted to a bottom surface 915 of the table 902 in contrast to being integral to the table.

Figure 9B:
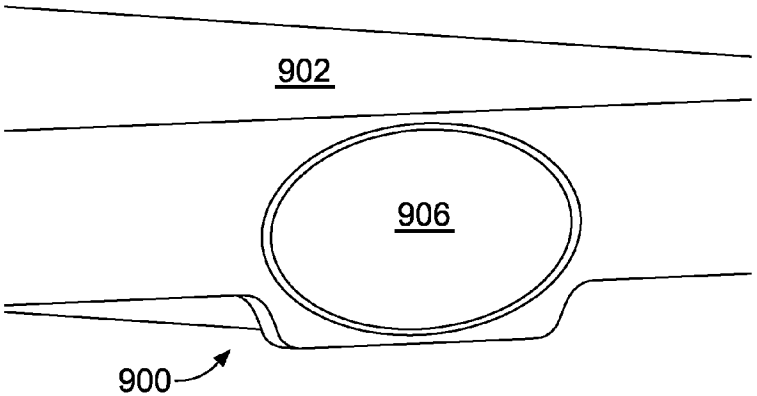
FIG. 9B is an enlarged perspective view of an inductive coupling unit of FIG. 9A mounted in a workbench in accordance with an embodiment of the invention.
Figure 9A:
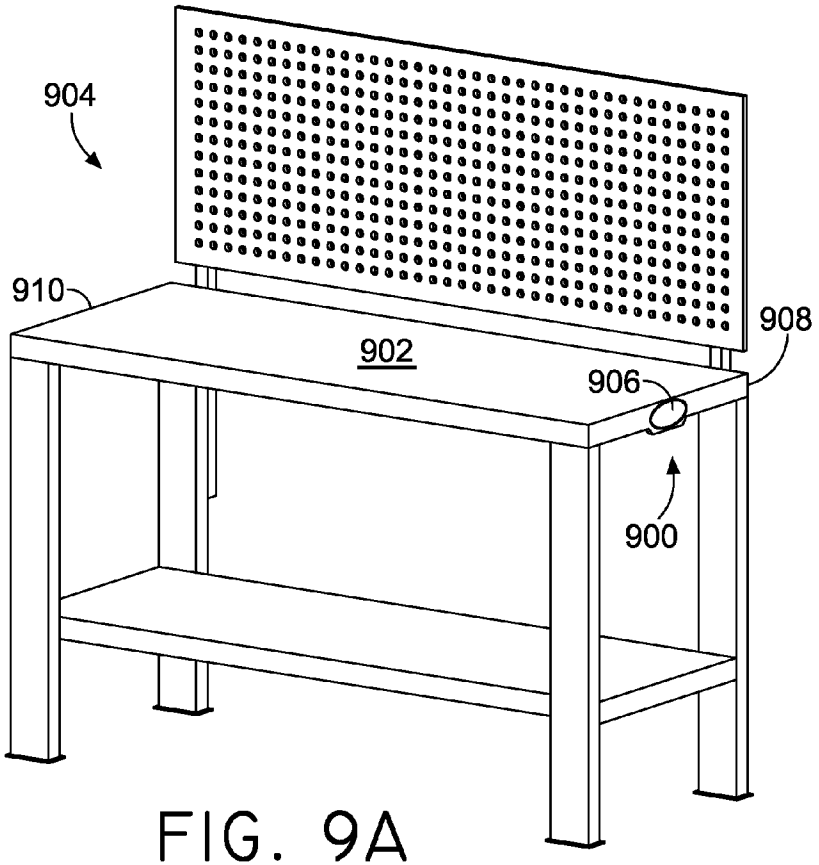
FIG. 9A is a perspective view of an inductively coupled power circuit mounted in a workbench in accordance with an embodiment of the invention.
Figure 9C:
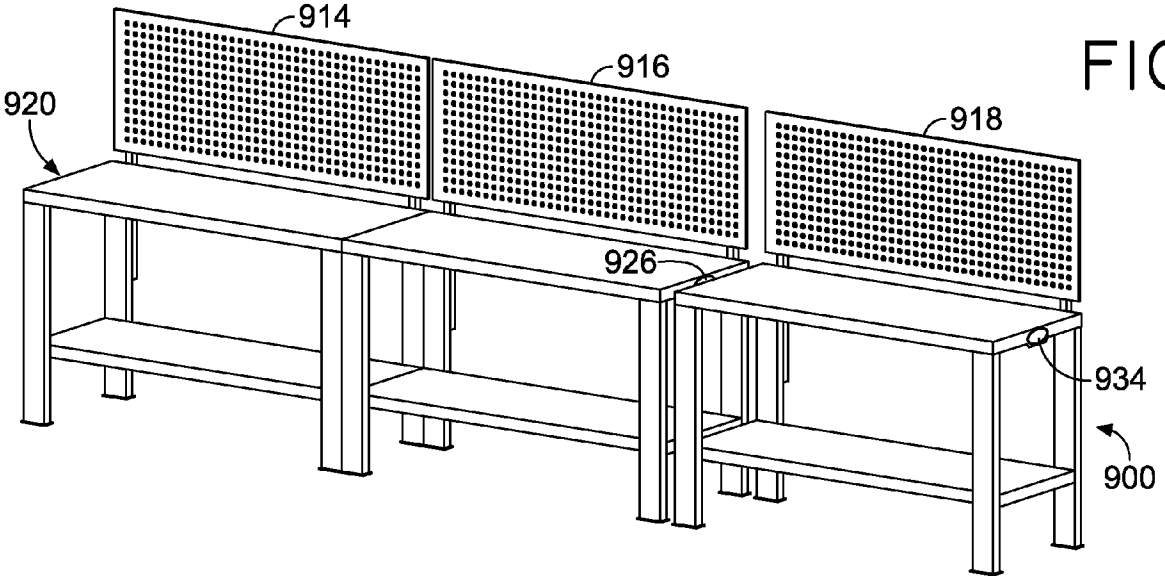
FIG. 9C is a perspective view of inductively coupled power circuits mounted within three workbenches being inductively coupled together in accordance with an embodiment of the invention.
Figure 9D:
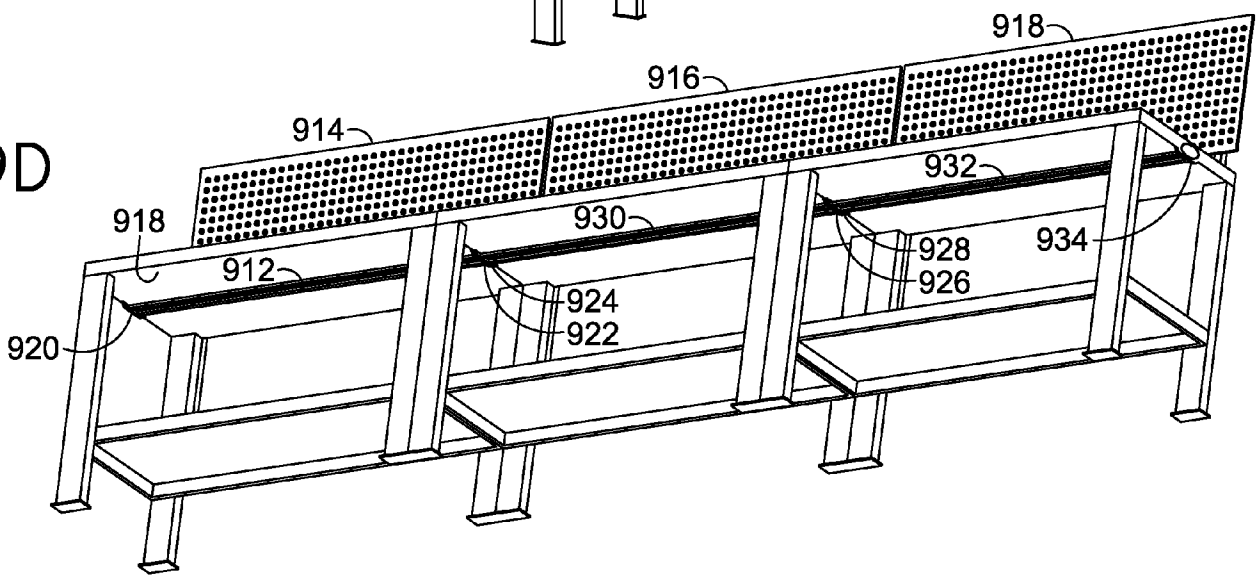
FIG. 9D is a perspective view from beneath the inductively coupled workbenches of FIG. 9C in accordance with an embodiment of the invention.

As best depicted in FIG. 9D, a pair of electrical connection segments 912 extends along the bottom surface of the table 902 between the IC units 906. The segments 912 provide electrical communication between the IC units 906 mounted at the first and second ends 908, 910 of the table 902. The segments 912 are affixed to the bottom surface 915 of the table 902 so as to eliminate stray electrical cords hanging beneath the table 902. The segments 912 include any desired electrical connection such as, for example and not limitation, solid, braided, or printed wires and may be housed within an enclosure or merely affixed to the bottom surface 915 by a plurality of fixtures.

As shown in FIGS. 9C and D, a plurality of workbenches 914, 916, and 918 are abutted together to place an IC unit 922 of a first workbench 914 in proximity to an IC unit 924 of a second workbench 916. Similarly, an IC unit 926 of the second workbench 916 is place in proximity to an IC unit 928 of the third workbench 918. As such, power supplied to an IC unit 920 of the first workbench 914 is transmitted through a segment 912 to the IC unit 922. The power is then transferred to the IC unit 924 via inductive coupling between the IC units 922 and 924. The power is subsequently similarly transmitted through a segment 930 to the IC units 926 and 928, through a segment 932 to an end IC unit 934. Thereby, power is supplied across the length of the workbenches 914, 916, 918 without any standard electrical connections or cords.

Further, power is supplied to the inductively coupled circuit 900 at any point along its path including along a segment 912, 930, or 932, or inductively to an IC unit 906, 920, 922, 924, 926, 928, or 934. The power may be supplied through a standard electrical cord and connection coupled to the circuit 900 or through an inductive coupling thereto. In embodiments, in which power is supplied to the circuit 900 via a standard electrical cord and connection, the benefits of the circuit 900 are still realized because only a single electrical cord is necessary in contrast to the many electrical cords that are displaced by the circuit 900.

The power transferred by the circuit 900 can be accessed at any point along the circuit 900 including along a segment 912, 930, or 932, or inductively to an IC unit 906, 920, 922, 924, 926, 928, or 934. As such, a module such as those described above or other electronic device may be connected to the circuit 900 and mounted in the table 902 to provide power at any location on the table 902. In another embodiment, one or more outlets or other electrical connections are provided on the table 902 by accessing the power of the circuit 900. Thus, the circuit 900 is gangable and enables devices to be connected thereto in various configurations, such as, for example, in a daisy chain configuration. The circuit 900 is described herein with respect to three workbenches 914, 916, and 918 however any number of workbenches may be similarly inductively coupled to provide power thereto. Further, more than one circuit 900 might be included within a single workbench 904, 914, 916, 918 and the arrangement of the circuit 900 may include any number of IC units 906 and arrangements of the segments 912.

Figure 10A:
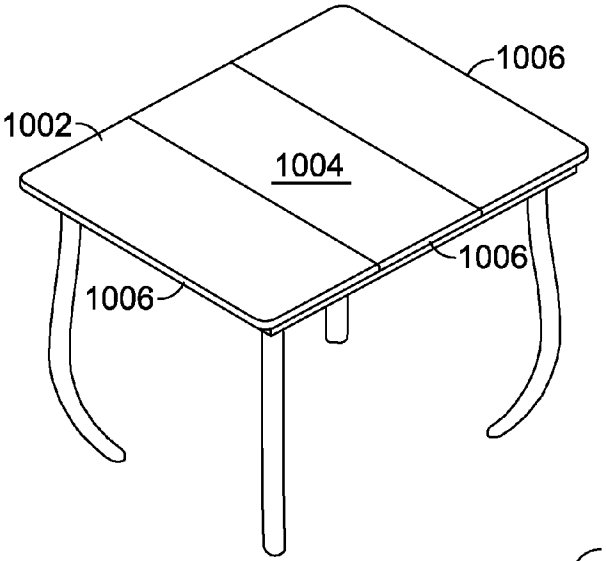
FIG. 10A is a perspective view of a table having an inductively coupled power circuit mounted to the underside thereof in accordance with an embodiment of the invention.
Figure 10B:
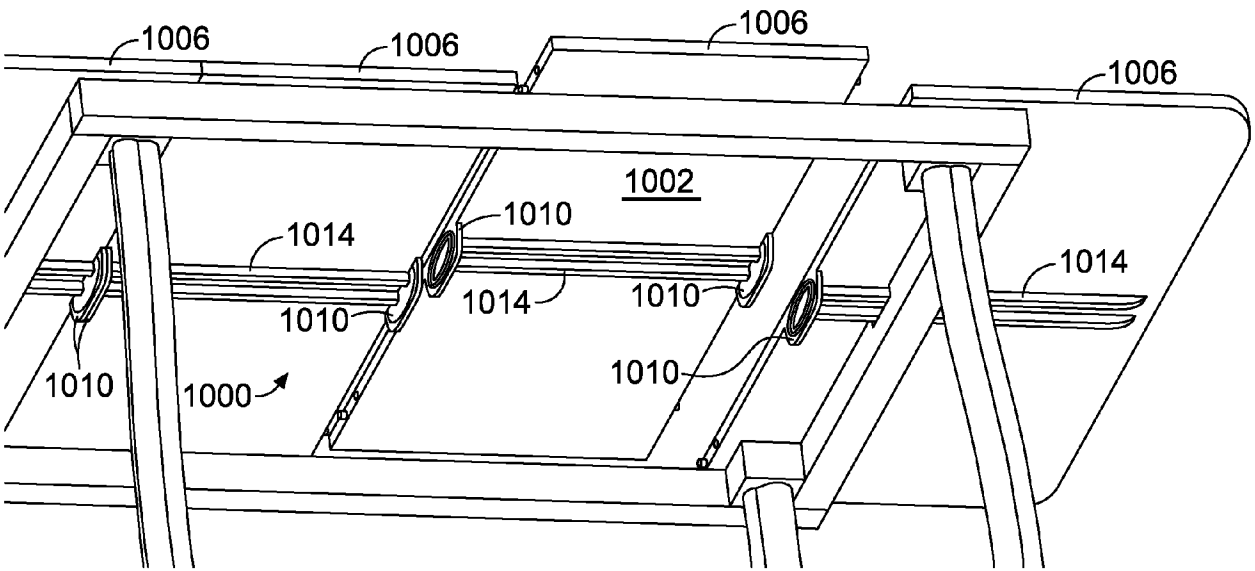
FIG. 10B is a perspective view from beneath the table of FIG. 10A in accordance with an embodiment of the invention.

With reference now to FIGS. 10A-B, 11A-B, and 12, a circuit 1000 is depicted in accordance with another embodiment of the invention. The circuit 1000 operates identically to that described above with respect to circuit 900 however the circuit 1000 is integrated into a table 1002, such as a dining table. The table 1002 is just one example of an article into which the circuit 1000 can be implemented and is not intended to limit the scope of the invention. As depicted in FIG. 10B the top 1004 of the table 1002 includes a plurality of leaves or sections 1006 that are removable to allow the size of the tabletop 1004 to be expanded or contracted. The circuit 1000 is secured to a bottom surface 1008 of each of the sections 1006. As such, each section includes an IC unit 1010 at each of two opposing sides.

As depicted in FIGS. 11A and B, the IC units 1010 are partially integrated into the tabletop 1004, but may be fully integrated into the table top or mounted to the bottom surface 1008 thereof. FIG. 11A depicts induction coils 1012 housed inside the IC unit 1010. Additionally, pairs of segments 1014 are mounted to the bottom 1008 of the tabletop 1004. In another embodiment, the two segments making up the pair of segments 1014 are combined. The segments 1014 provide electrical communication between the IC units 1010 on a single section 1006 of the tabletop 1004.

As such, the circuit 1000 allows transfer of electrical power along the length of the tabletop 1004. As described previously with respect to the circuit 900, power can be supplied to the circuit 1000 at any point along the circuit by a standard electrical cord and connection or by an inductive coupling thereto. Additionally, the tabletop 1004 can be expanded or contracted by adding or removing one or more sections 1006. Because each of the sections 1006 includes a pair of IC units 1010 and segments 1014, the circuit 1000 is also expanded or contracted with the tabletop 1004. Thus, power can be supplied to any location on the tabletop 1004 no matter how many sections 1006 are added or removed. Also as described above, one or more modules or other devices may be coupled to the circuit to use or distribute the power transferred thereby.

Figure 13A:
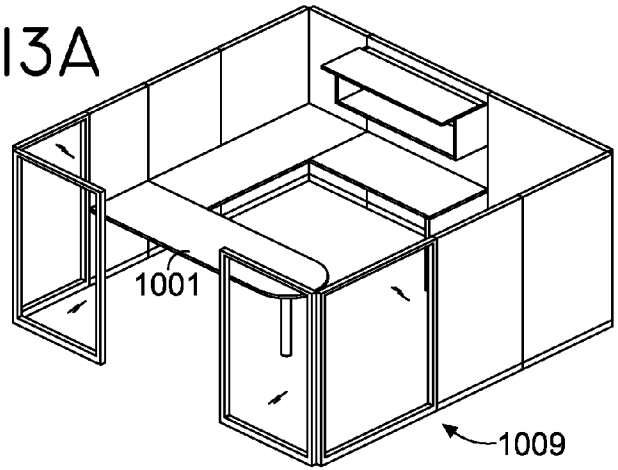
FIG. 13A is a perspective view depicting a modular desktop having an inductively coupled power circuit mounted therein in accordance with an embodiment of the invention.
Figure 13C:
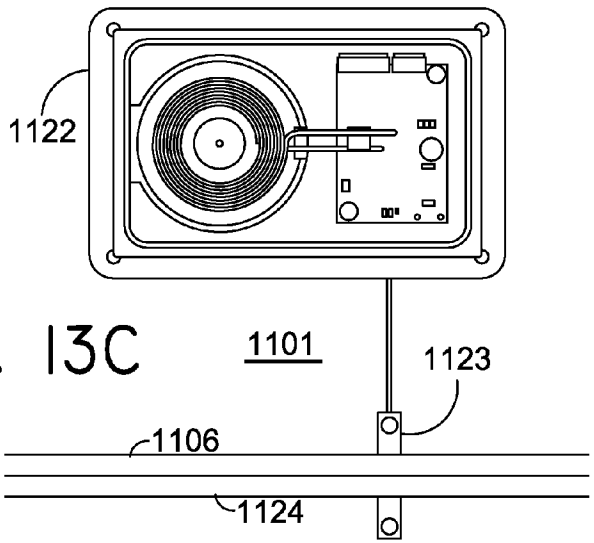
FIG. 13C is a plan view of an inductive coupling module mounted on the modular desktop of FIG. 13A and coupled to an inductively coupled circuit in accordance with an embodiment of the invention.
Figure 13B:
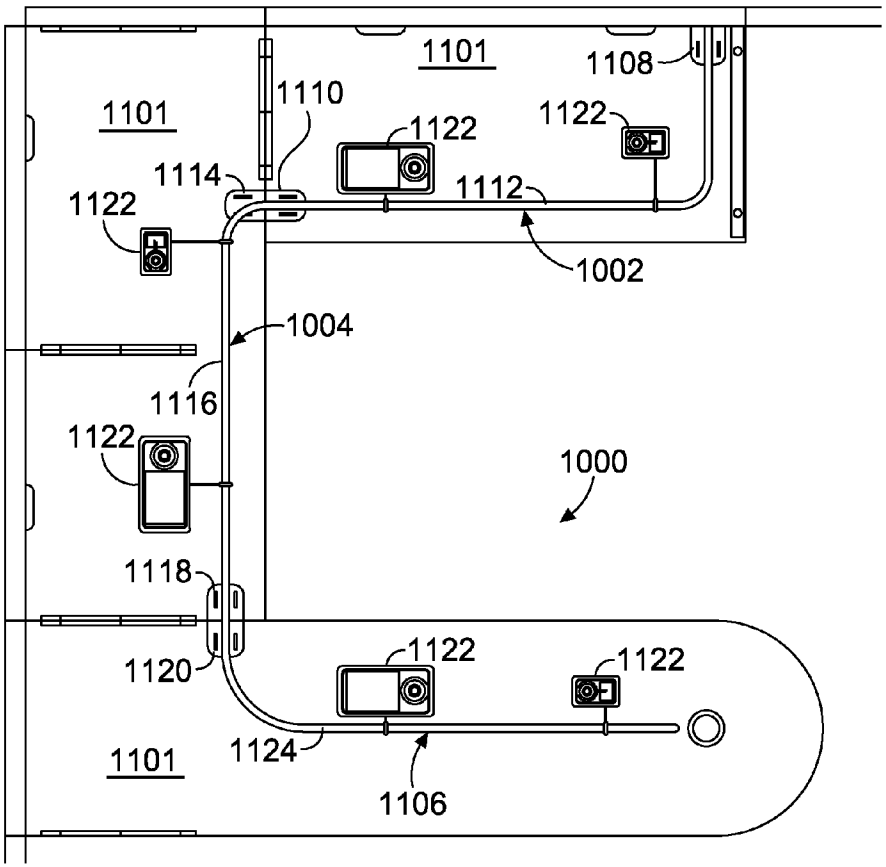
FIG. 13B is a bottom plan view of the modular desktop of FIG. 13A depicting an inductively coupled power circuit and inductive coupling modules mounted thereon in accordance with an embodiment of the invention.

FIGS. 13A-C depict a circuit 1100 in accordance with an embodiment of the invention. The circuit 1100 is affixed to a plurality of modular desktop panels 1101. The circuit 1100 includes a first segment 1102, a second segment 1104, and a third segment 1106. The first segment 1102 includes an IC unit 1108 at a first end and an IC unit 1110 at a second end. The first IC unit 1108 inductively couples the circuit 1100 to a power source via a complimentary IC unit (not shown) housed in a wall of a cubicle 1109 in which the circuit 1100 is located. As such, power is supplied to the circuit 1100 by an inductive coupling with the IC unit 1108.

Power is transferred along the first segment 1102 by a connecting run 1112 comprising any available means described above. The power is transferred to the second segment 1104 through an inductive coupling between the IC unit 1110 and an IC unit 1114 at a first end of the second segment 1104. The power is similarly transferred along a second connecting run 1116 to an IC unit 1118 at a second end of the second segment 1104 and inductively transferred to the third segment 1106 via an inductive coupling between the IC unit 1118 and an IC unit 1120 of the third segment 1106.

Additionally depicted in FIGS. 11B and C, a plurality of modules 1122, such as the modules 200-800 described above, are mounted to an underside of the desktop panels 1101. The modules 1122 are connected to the circuit 1100 via a quick-connect or plug-n-play connection 1123 to the connecting runs 1112, 1116, and a connecting run 1124 of the third segment 1106. In an embodiment, the modules 1122 are connected to the circuit 1100 in any available manner including splicing of wires, plug connections, piercing connections, and hardwiring, among others. As such, the modules 1122 provide locations on the desktop panels 1101 at which a secondary device having a secondary coil may be placed to inductively couple to a module 1122 and to the circuit 1100 to obtain power for operation or charging.

It should be understood that any number of modules can be installed, and corresponding charging zones created, in any position. It should be also be understood that the rechargeable devices described are merely exemplary, and that a virtually unlimited number and variety of devices can be charged through the modules installed in the desktop, so long as they are provided with the proper secondary coil. Additionally, implementations of modules installed in a surface as described above are contemplated as either newly manufactured items, also known as original equipment manufacture (OEM) in which one or more primary coils are installed before sale, and as aftermarket products such as a kit including one or more modules that may be installed after sale.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

What is claimed is:

1. An inductively coupling module comprising:

a housing attachable to a first side of a panel that opposes a second side of the panel, at least a portion of the housing extending into a first cavity in the first side;

an induction coil disposed within the housing and located within an operating distance of a top surface of the second side of the panel opposite the first side;

control electronics disposed within the housing for controlling the operation of the induction coil and connecting to a power source;

a cord attached at a first end to the control electronics, the cord having a second end that opposes, and is spaced a length apart from, the first end; and an indicator attached to the second end of the cord, wherein the length of the cord is sufficient for the indicator to insert into a second cavity in the first side of the panel and to be viewable through the top surface.

2. The inductively coupling module of claim 1, wherein the indicator includes:

a light source that is visible from the second side of the panel to provide an indication of the status of the inductively coupling module.

3. The inductively coupling module of claim 1, wherein the housing further comprises a body portion and a coil portion, the body portion substantially containing the control electronics and the coil portion containing the induction coil, wherein the coil portion is cylindrical and extends from a surface of the body portion at least partially into the cavity in the first side of the panel.

4. The inductively coupling module of claim 3, wherein a distance that the coil portion extends from the body portion is adjustable to conform the coil portion to a depth of the cavity in the first side of the panel and, wherein the coil portion is biased toward an extended position.

5. The inductively coupling module of claim 4, wherein the coil portion includes a plurality of telescoping segments.

6. The inductively coupling module of claim 3, wherein at least a portion of the body portion is disposed in the cavity in the first side of the panel.

7. The inductively coupling module of claim 1, wherein the induction coil is one or more of a low power, a medium power, and a high power induction coil.

8. The inductively coupling module of claim 1, wherein the cavity in the first side of the panel extends only partially through a thickness of the panel to provide the inductively coupling module in a sub-surface configuration with respect to the second side of the panel or, the cavity comprises a through hole that extends through the thickness of the panel and the first and second sides to provide the inductively coupling module in a flush-mount configuration with a portion of the housing exposed and level with the top surface of the second side of the panel or in a surface-mount configuration with a portion of the housing extending above the top surface of second side of the panel.

9. An inductively coupling power distribution circuit for an article of modular furniture comprising:

a first induction coil disposed along a first side of a first article of modular furniture;

a second induction coil disposed along a second side of the first article of modular furniture; and an electrical conductor coupled to both the first and second induction coils and providing electrical communication between the first and second induction coils, wherein first article of modular furniture is inductively coupled to one or more of a source of electrical power and one or more second similarly configured articles of modular furniture, and wherein one or more electronic devices are coupled to the electrical conductor to supply power to the electronic device.

10. The power distribution circuit of claim 9, wherein one or more of the electronic devices comprise inductively coupling power modules that are mounted on the first or second articles of furniture.

11. The power distribution circuit of claim 9, wherein the first and second articles of modular furniture include a panel and the first and second induction coils are disposed at least partially within a body of the panel and at opposite edges of the panel.

12. The power distribution circuit of claim 9, wherein a plurality of first and second articles of furniture are inductively coupled together in one or more of a series circuit, parallel circuit, or daisy chain circuit configuration.

13. The power distribution circuit of claim 9, wherein the electrical conductor is configured to accept a quick-connect or plug-n-play connection.

14. The power distribution circuit of claim 9, wherein the first and second articles of modular furniture comprise desktop panels, tabletop panels, workbenches, office cubical components, and seating furniture components.

15. The power distribution circuit of claim 9, wherein the first and second articles of modular furniture comprise leaves of an expandable tabletop.

16. An inductively coupling power distribution circuit for an article of modular furniture comprising:

a plurality of desktop panels;

a first induction coil disposed along a first edge of each of the plurality of desktop panels;

a second induction coil disposed along a second edge of each of the plurality of desktop panels, wherein the second edge is the same or different than the first edge;

an electrical conductor coupled between the respective first and second induction coils on each desktop panel and providing electrical communication between the first and second induction coils;

one or more inductively coupling modules disposed on or within an underside of each of the plurality of desktop panels and electrically coupled to the electrical conductor on a respective panel; and an electrical coupling between the first induction coil on at least one of the plurality of panels and a source of electrical power, wherein at least one of the first or second induction coil disposed on each of the plurality of desktop panels is inductively coupled to the first or second induction coil disposed on at least one other of the plurality of desktop panels to form an electrical circuit connecting all of the plurality of panels.

17. The power distribution circuit of claim 16, wherein the electrical coupling between the first induction coil on at least one of the plurality of panels and the source of electrical power is an inductive coupling.

18. The power distribution circuit of claim 16, wherein the inductively coupling modules disposed on or within an underside of each of the plurality of desktop panels further comprise:

a housing coupled to an underside of the desktop panel, at least a portion of the housing extending into a cavity in the underside of the desktop panel;

an induction coil disposed within the housing and located within an operating distance of a top surface of the desktop panel, the induction coil being against or adjacent to an interior surface of the housing and within the portion of the housing that extends into the cavity; and control electronics disposed within the housing for controlling the operation of the induction coil and connecting to the electrical conductor.

19. The power distribution circuit of claim 18, wherein the housing further comprises a body portion and a coil portion, the body portion housing the control electronics and the coil portion housing the induction coil, wherein the coil portion is cylindrical and extends from the body portion at least partially into the cavity in the underside of the desktop panel, wherein a distance that the coil portion extends from the body portion is adjustable to conform the coil portion to a depth of the cavity in the underside of the desktop panel, and wherein the coil portion is biased toward an extended position.

20. The power distribution circuit of claim 16, wherein the electrical conductor is configured to accept a quick-connect or plug-n-play connection.

* * * * *